US006536788B1

(12) United States Patent
Kuncz et al.

(10) Patent No.: US 6,536,788 B1
(45) Date of Patent: Mar. 25, 2003

(54) SKATEBOARD INTEGRAL INTERCHANGEABLE INDEPENDENT SUSPENSION TRUCK-FREE WITH AERODYNAMIC BOARD DESIGN AND ROLLING DEVICES SYSTEMS

(76) Inventors: Ferenc Kuncz, 15464 SW. 114 St., Miami, FL (US) 33196; Harold Kuncz, 15464 SW. 114 St., Miami, FL (US) 33196; Igor O. Kuncz, 15464 SW. 114 St., Miami, FL (US) 33196

( * ) Notice: Subject to any disclaimer, the term of this patent is extended or adjusted under 35 U.S.C. 154(b) by 150 days.

(21) Appl. No.: 09/699,587

(22) Filed: Oct. 30, 2000

(51) Int. Cl.[7] ..... A63C 17/02; A63C 17/01

(52) U.S. Cl. ..... 280/87.041; 280/87.042; 280/11.28

(58) Field of Search ..... 280/87.041, 87.042, 280/87.04, 11.12, 11.115, 11.18, 11.19, 11.233, 11.285, 11.27, 11.28, 11.29, 11.223

(56) References Cited

U.S. PATENT DOCUMENTS

| | | | | | |
|---|---|---|---|---|---|
| 1,034,649 | A | * | 8/1912 | Rice | 280/11.223 |
| 4,089,536 | A | * | 5/1978 | Larrucea | 280/11.28 |
| 4,955,626 | A | * | 9/1990 | Smith et al. | 280/11.28 |
| 5,478,095 | A | * | 12/1995 | Marandel | 280/11.28 |
| 5,868,408 | A | * | 2/1999 | Miller | 280/87.042 |
| 6,039,329 | A | * | 3/2000 | Burns et al. | 280/11.19 |
| 6,123,348 | A | * | 9/2000 | Miller | 280/87.042 |

FOREIGN PATENT DOCUMENTS

| | | | | | |
|---|---|---|---|---|---|
| DE | 2942210 | A1 | * | 6/1991 | 280/87.042 |
| EP | 0557872 | A1 | * | 9/1993 | 280/87.042 |
| EP | 0558776 | A1 | * | 9/1993 | 280/87.042 |
| EP | 0573677 | A1 | * | 12/1993 | 280/87.042 |
| GB | 2242135 | A | * | 9/1991 | 280/87.042 |

* cited by examiner

*Primary Examiner*—Lanna Mai
*Assistant Examiner*—Hau Phan

(57) ABSTRACT

A skateboard in accordance with this present invention includes a aerodynamic deck design and the aerodynamic board supporting at least four interchangeable independent chassis supporting at least four removable integral multiple action independent suspension truck-free system, the suspension system support at least four and eight-wheeled configurations having all forks axles pivotally in forward motion and opposite direction from each other. The integral independent suspension system all parts and components are integrated in a body-frame, includes at least two independent shock-absorber mechanisms in whish the front shock-absorber suspension mechanisms interconnects with the rear shock-absorber secondary mechanisms, in which the rear shock-absorber mechanisms support the pivotally axles and wheel system. The integral independent suspension and chassis system are mounted on the middle half section under the deck platform top side extension fender which used at control area for operable steering and general maneuvers. The skateboard has a plurality of rolling devices longitudinally and laterally aligned under the central deck-platform. The skateboard deck supports the interchangeable and independent suspension and chassis system trough a plurality of removable fasteners. The deck platform high-impact edge bumper protector supporting a phosphorescent light indicator devices and the both top platform decks support an angular upward-bent from 0–18 degrees.

1 Claim, 16 Drawing Sheets

SKATEBOARD INTEGRAL INTERCHANGEABLE INDEPENDENT SUSPENSION TRUCK-FREE WITH AERODYNAMIC BOARD DESIGN AND ROLLING DEVICES SYSTEMS

BACKGROUND OF THE INVENTION

1. Field of the Invention

This present invention relates to a skateboard multiple action integral independent suspension truck-free with aerodynamic deck design and rolling devices system, and more particularly to a aerodynamic deck platform supporting interchangeable independent suspension and chassis supporting and utilizing a interchangeable and adjustable independent suspension truck-free system, which improve the skaters supreme dynamic push-off-force forward and lateral sliding free-style adding highest skateboard performance and stability in all surface conditions.

2. Description of the Related Art

Skateboard have became very popular in the last years for sports and exercises specially in young generation participation, the skateboard that actually we know and the problem that represent to skaters due to the unfavorable conditions of roads surfaces are only some of the reasons for which we present our version of this skateboard present invention, since, they will be to stimulate and to correct the technical problems and those of performances, also, the current skateboard they don't only represent a problem from road surface conditions due to the designs of complex subduing systems, but they rather present technical problems and physiques for the skaters in general, this above problems and many others we will solve with our skateboard present invention.

The original idea of the skateboard it was to imitate the surfboard patterns technology, adding a plurality of wheels mounted on the underside longitudinal axis of the board or deck with two front and rear wheeled mechanisms known as trucks, this said trucks devices systems it's mounted to the deck an supporting the pivoting shafting dynamics of the skateboard, the central longitudinal axis of the classic skateboard platform deck are completely made with a flat characteristics and the both front and rear ends of the deck are bent upward without mentioning any others characteristics of platform sizes, board or deck materials construction modes, wheels composition and all combinations of parts and components involve in the conventional skateboard quality and performances.

The findamental real problem with the conventional skateboards in particular the classic skateboard mentioned before and all types of new improved skateboards systems available today likes in-line roller skateboards with or without rotatable or steerable alignment, tandem mounted or plurality of in-line wheels arrangements with all front and rear wheels combinations, all others types of skateboards which includes mounted control devices likes brakes or manually steering the wheels or brakes, different sizes of wheels configurations under the platform, supporting mechanical devices, steerable platform for wheels steers, all classic skateboards with longitudinal mounted trucks devices in all combinations with or without rotatable front or rear trucks configurations we denominate the "Concept of Skateboarding Patterns", that means the differences between those conventional or improved skateboards mentioned above and our skateboard related in this present invention, this concept of skateboarding patterns on wheels are specially related to skateboards who support any type of trucks devices and all system mounted on, excepting our skateboard presented in this invention which has a new aerodynamic deck design, high technology concept and state-of-the-art integral independent suspension and rolling devices systems, all parts and components without trucks devices allowing to this system to be the skateboard who has the highest performances and new concept of total extreme skateboarding choices with the superior capability and stability in all surface conditions providing aerodynamic new design and high quality smoother-rides, higher, faster and longer jumping acrobatics free-style forward and lateral sliding technique maneuvers that the conventional most popular four wheeled trucks-on mounted skateboards.

The Followings U.S. patent Number's discloses in brief descriptions many of the backgrounds and acknowledge of each invention.

U.S. Pat. No. 4,062,557, Roden, granted in Dec. 13, 1977, disclose a skateboard supporting four wheels centrally pivoted front and rear to the respective axle, in this patent matter, Roden doesn't relate a skateboard comprising integral independent suspension truck-less with aerodynamic deck design and rolling devices systems.

U.S. Pat. No, 4,337,961, Covert et al, granted in Jul. 6, 1982, disclose a skateboard supporting conventional axles with four trucks pivoting independently, in this patent matter, Covert et al, doesn't relate a skateboard comprising integral independent suspension truck-less with aerodynamic deck design and rolling devices systems.

U.S. Pat. No. 5,165,710, Runyon, granted in Nov. 24, 1992, disclose a skateboard with mechanical rotor for the propose of energy recovery and transfer this said energy back to the wheels, in this patent matter, Runyon, doesn't relate a skateboard comprising integral independent suspension truck-less with aerodynamic deck design and rolling devices systems.

U.S. Pat. No. 5,236,208, Welsh, granted in Aug. 17, 1993, disclose a skateboard with a fully steerable deck mounted platform supporting a steering mechanism attached to the chassis, in this patent matter, Welsh, doesn't relate a skateboard comprising integral independent suspension truck-less with aerodynamic deck design and rolling devices systems.

U.S. Pat. No. 5,263,725, Gesmer et al, granted in Nov. 23, 1993, disclose a conventional skateboard truck improvements supporting a coils springs attached to a central body and a yoke containing the trucks devices, Gesmer et al, in this patent matter, doesn't relate a skateboard comprising integral independent suspension truck-less with aerodynamic deck design and rolling devices systems.

U.S. Pat. No. 5,522, 620, Pracas, granted in Jun. 4, 1996, disclose a conventional skaboard configuration having a pivotal member which is connected to the deck a mechanism to lock and unlock the said truck device, Pracas, in this patent matter, doesn't relate a skateboard comprising integral independent suspension truck-less with aerodynamic deck design and rolling devices systems.

U.S. Pat. No. 5,992,865, Vargas, granted in Nov. 30, 1999, disclose a skateboard with a plurality of front and rear steerable wheels system, Vargas, in this patent matter, doesn't relate a skateboard comprising integral independent suspension truck-less with aerodynamic deck design and rolling devices systems.

SUMMARY OF THE INVENTION

This skateboard in accordance with this present invention, there is provided a newly aerodynamic design skateboard deck platform assembly which includes a interchangeable chassis supporting the removable and adjustable front and rear integral independent double action suspension system all parts and components. Further, longitudinally and laterally in-line-aligned under the central deck platform and between the front and rear wheels is attached a plurality novel design rolling devices system.

It is a further object of the present invention to provide a individually attached removable chassis under the front and rear middle half section board platform either opposite edge side fender extension supports the removable independent suspension systems fourwheeled or eight-wheeled mounted configuration with all parts and mechanical components build in accordance with the present invention.

Additional object of the invention are the deck platform cover edges which supporting a security phosphorescent light for night ride with three-colors: front white, rear red and both side yellow, also this particular cover protects the skateboard edges against high impacts or scratches.

In this particular embodiment the skateboard independent integral suspension system other further object of the present invention is to detail the shock absorber main chamber assembly section and support the hydraulic fluid-flow primary reservoir chamber, this hydraulic fluid-flow main chamber support the main shaft and around the main shaft a shock coil spring take place, the end part of the main shaft is attached the shock piston, the shocks piston front exterior side is attached to a adjuster knob, this adjuster knob manually adjust and regulate the compression and extension pressure position of the shock absorber spring coils, the shock absorber chamber rear assembly is supported trough is shaft guide also this shaft guide device control and seal the main shaft, this middle shaft front part it's interconnected trough a middle pivoting axle and the rear part of this middle shaft is attached and connected to the rear pivot head central trigger trough a rear middle precision pivot axle, this middle precision pivot axle interconnects the pivot axle with two precision ball bearings.

The front shock absorber assembly system it is therefore an object of the present invention is to detail a lateral double chambers hydraulic fluid-flow second reservoir, this dual chambers supporting and controlling the shock absorber (extension-compression main spring high and low speed pressure function) front hydraulic fluid flow damper control valve and the chamber support the shock absorber (compression function) rear hydraulic fluid flow damper control valve, the damper control valve and interact with the main piston head and control independently the compression valve and extension valve function of the shock absorber damper pressure restriction the speed of hydraulic fluidflow, the full-flow valve control support the hydraulic full-flow by-pass device system. The backside assembling of the suspension system it is therefore an other object of the present invention to includes rear axle pivot independent shock absorber chamber system and control the down-force-pressure applied to the pivot axle, forks and rolling devices in ground position and support the torsion coils springs and ball bearing systems, the rear axle torsion springs coils is supported trough a main rear shaft and a torsion coils spring retainer collar, the manually adjuster knob adjust the skaters weight torsion coils springs pressure screw and support and share the total lift weight (push-off-force) suspension capacity with the main shock absorber, the middle part of the said backside Pivoting axle shaft support the central fixed head trigger and rolling over a precision ball bearing device the forks eyelets and the pressure screw cover.

Another embodiment of the present invention its represented for the front and rear integral independent suspension system with eight-wheeled configuration which incorporate four tandem wheeled mounted with each respective chassis system, the front and rear suspension are complete independent, the front and rear independent suspension system with four-wheeled configuration, support four individual wheeled suspension with each respective chassis system, the front and rear suspension both pivoting forward in opposite direction.

It is therefore an principal object of this invention to provide an skateboard independent integral suspension truck-less system compatible and adjustable to all skaters styles and requirements without limits, reducing physically stress of skaters and improving general performances and high stability and control over all surfaces conditions.

BRIEF DESCRIPTION OF THE DRAWINGS.

Other objects, features and advantages will occur to those skilled in the art from the Following description of a preferred embodiment and the accompanying drawings, in which.

DETAILED DISCLOSURE OF PREFERRED EMBODIMENTS.

Figure 1:
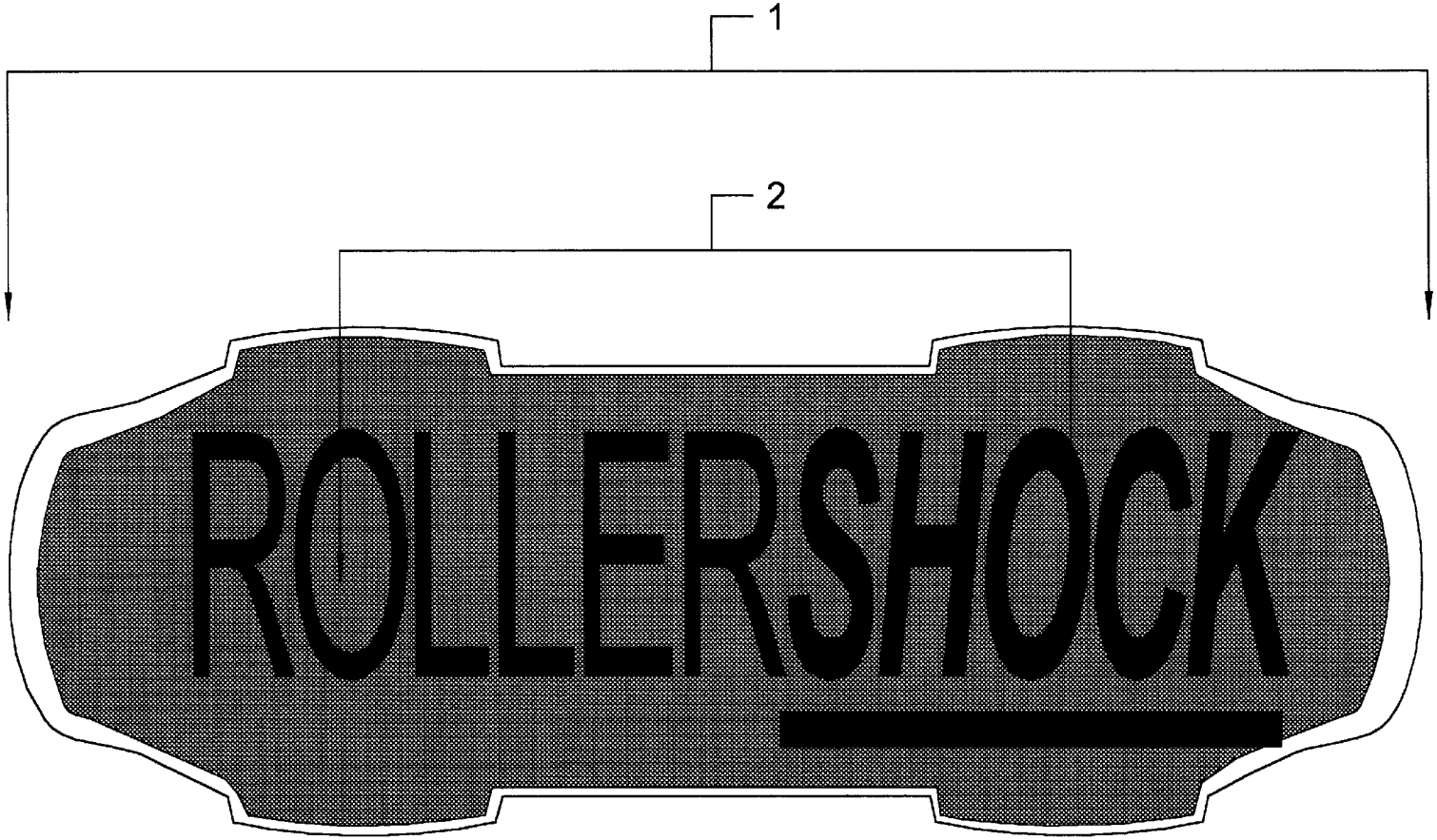
FIG. 1 is a top elevation view of a Skateboard showing the innovative deck aerodynamic design and the top platform anatomic rubber-grip-tape design according to an embodiment of the present invention.

Referring to FIG. 1 is a top elevation view of a Skateboard showing the innovative aerodynamic deck design 1 and the top platform anatomic rubber-grip-tape design 2 according to an embodiment of the present invention.

Figure 2:
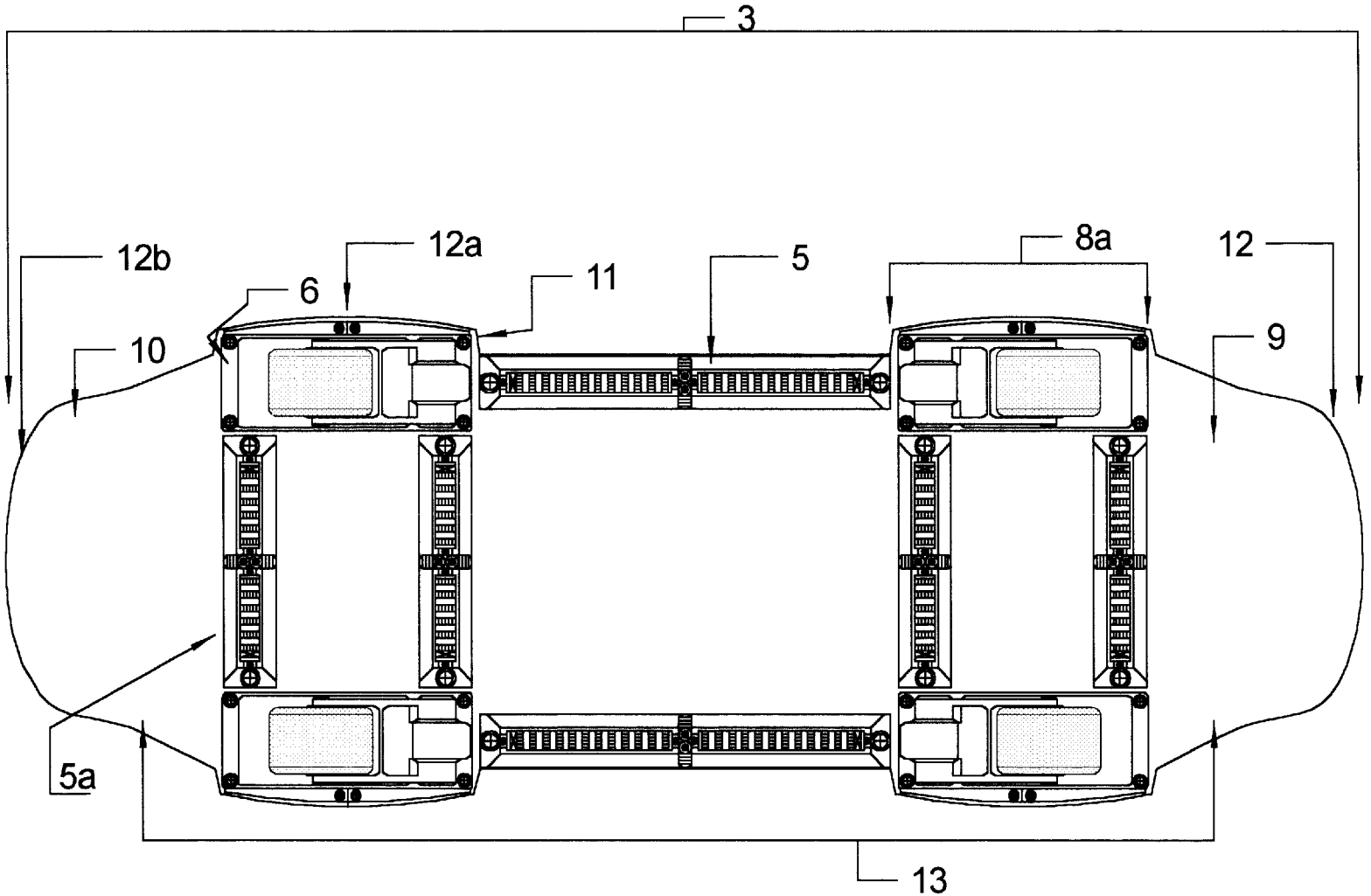
FIG. 2 is a bottom elevation view of the preferred embodiment of a skateboard an interchangeable independent chassis supporting the removable integral dual action independent suspension truck-free four-wheeled configuration system and showing the innovative in-line rolling devices system all parts and components, which is constructed in accordance with the present invention.

Referring to FIG. 2, is a bottom elevation view of the preferred embodiment of a Skateboard 3 an the interchangeable independent chassis 6 which is the support of the independent integral suspension truck-free four-wheeled configuration system 8*a* and detailing the innovative in-line-rolling devices 5 longitudinally and 5*a* laterally aligned under the central portion of the deck platform, the other important part of the skateboard is the stainless-steel protector base plate 9 who protect the total area of the platform deck core against heavy surface damage and scratches, the deck four fender extension 11 support the accommodations of the four-wheeled configuration 8*a* independent integral suspension system and the removable chassis 6, the bumper 10 covers the edge of the skateboard and protect them against lateral and frontal impacts, the cover edges sections 12, 12*a* and 12*b* represents the security night ride phosphorescent indicators lights, front cover edge 12*b* white, side cover edge 12*a* yellow and rear cover edge 12*b* red, the platform deck bent section 13 is approximately 18°, this particular skateboard overall measuring is 8×32 and the extension platform section is 12 inches wide and ⅜ inches thickness and the stainless-steel base plate is under 0.30 mm thickness as well its parts and mechanical components build in accordance with the present invention.

Figure 2A:
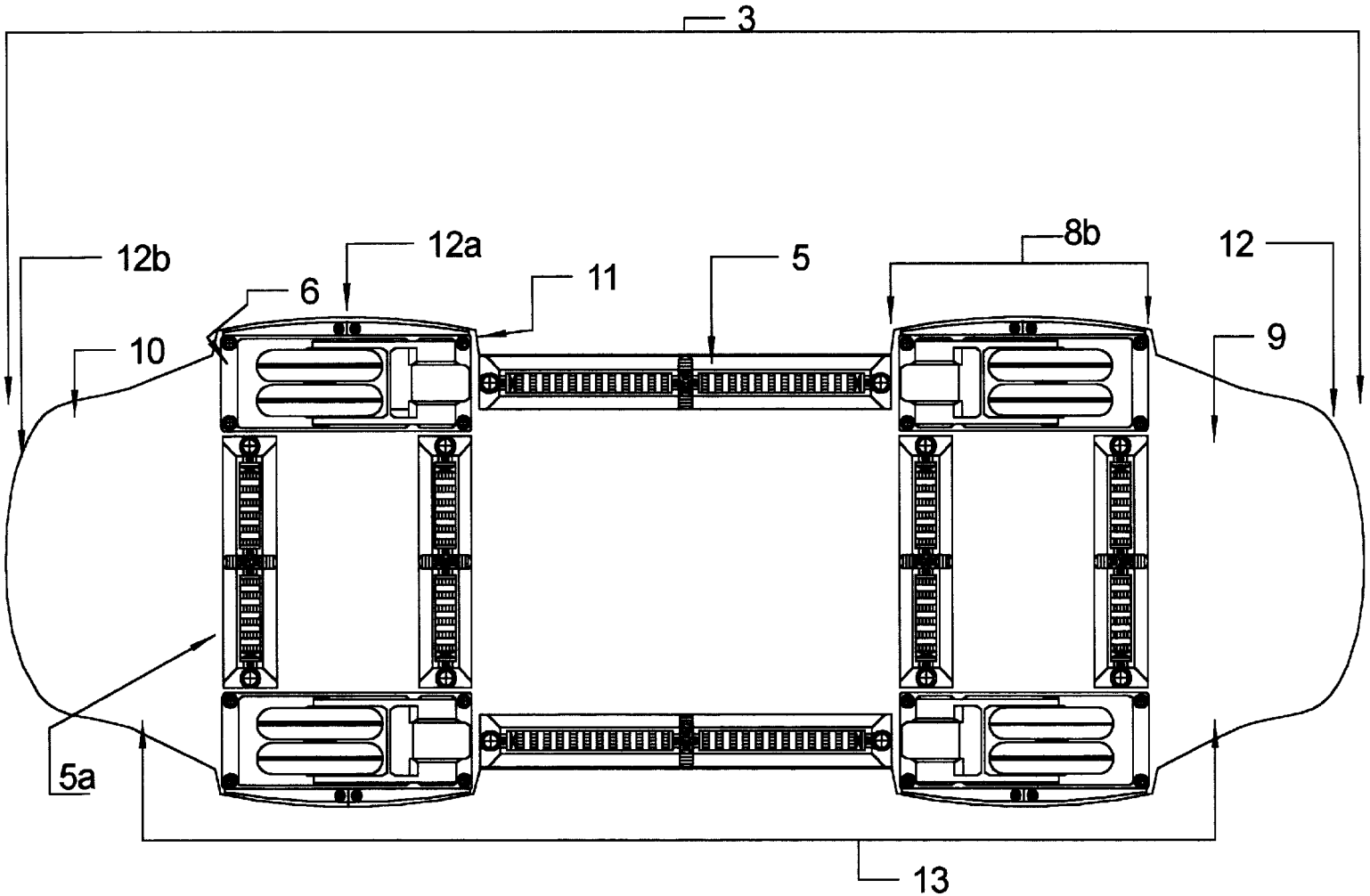
FIG. 2*a* is a bottom elevation view of the preferred embodiment of a skateboard an interchangeable independent chassis supporting the removable integral dual action independent suspension truck-free eight-wheeled configuration system and showing the innovative in-line rolling system all parts and components, which is constructed in accordance with the present invention.

Referring to FIG. 2*a,* is a bottom elevation view of the preferred embodiment of a Skateboard 3 and the interchangeable independent chassis 6 which is the support of the independent integral suspension truck-free eight-wheeled configuration system 8*b* and detailing the innovative in-line-rolling devices 5 longitudinally and 5*a* laterally aligned under the central portion of the deck platform, the other important part of the skateboard is the stainless-steel protector base plate 9 which protects the total area of the platform deck core against heavy surface damage and scratches, the deck four fender extension 11 support the accommodations of the eight-wheeled configuration 8*b* independent integral suspension system and the removable chassis 6, the bumper 10 covers the edge of the skateboard and protect them against lateral and frontal impacts, the cover edges sections 12, 12*a* and 12 *b* represents the security night ride phosphorescent indicators lights, front cover edge 12*b* white, side cover edge 12*a* yellow and rear cover edge 12*b* red, the platform deck bent section 13 is approximately 18°, this particular skateboard overall measuring is 8×32 and the extension platform section is 12 inches wide and ⅜ inches thickness and the stainless-steel base plate is under 0,30 mm thickness as well its parts and mechanical components build in accordance with the present invention.

Figure 3:
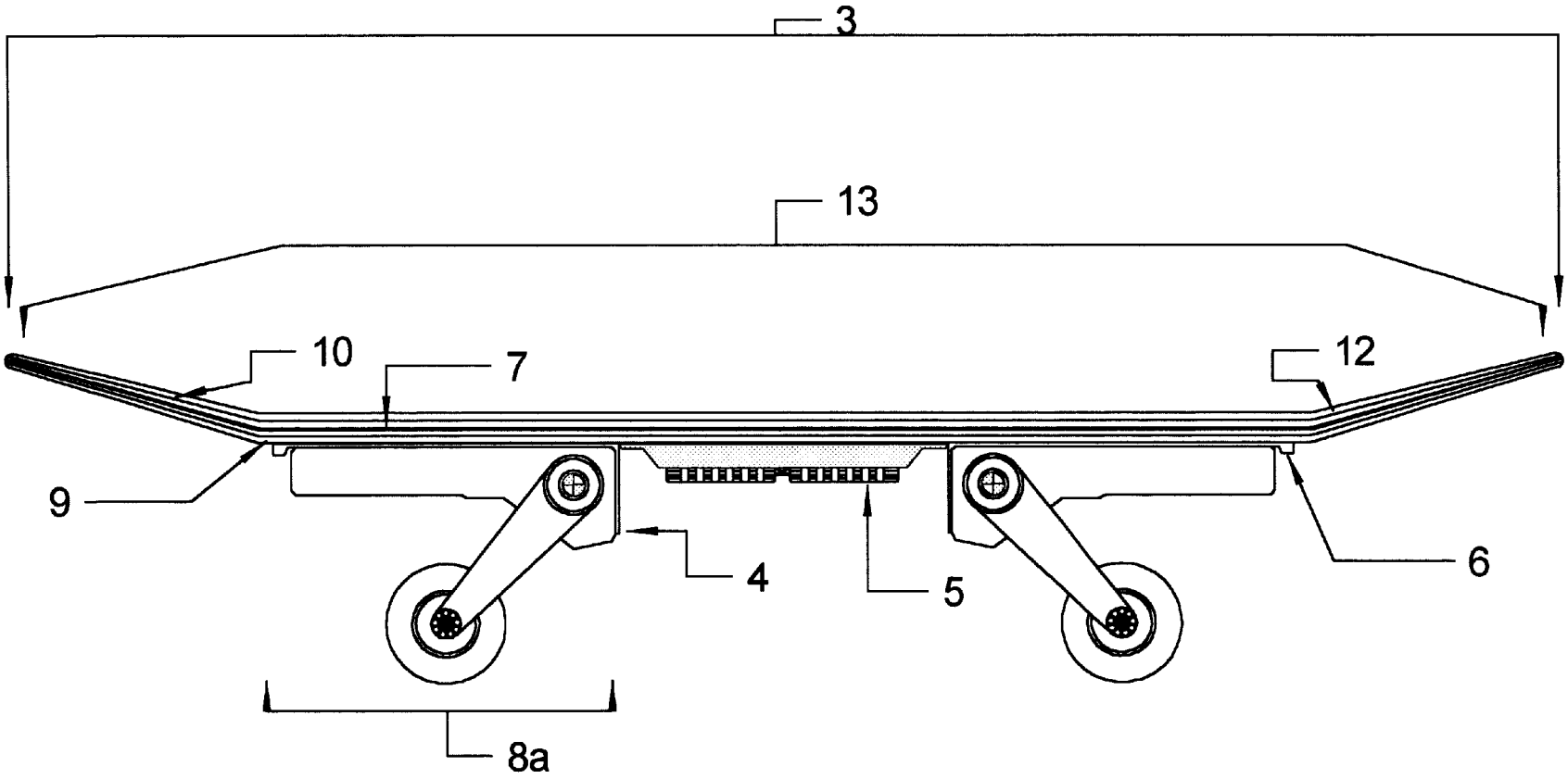
FIG. 3 is a side elevation view of a skateboard front and rear independent suspension system four-wheeled configuration, detailing the innovative design deck side view, rolling devices and suspension protector plate showing all parts and components, which is constructed in according an embodiment of the present invention.

Referring to FIG. 3 is a side elevation view of a skateboard front and rear independent integral suspension system 8*a* four-wheeled configuration and partially side view of the chassis 6 and detailing the innovative deck side view 3, the central middle section of the platform support the in-line-rolling system devices 5, the center of the deck core assembly incorporate the inter-layer middle stainless plate 7 and detailing the core deck base plate 9, the all around bumpers high impacts protector 10 and the side night ride phosphorescent light devices 12, the suspension system rear side incorporate a high impact metal base protector 4, the both end of the platform skateboard deck are bent upward aprox. 18°, the four wheeled suspension system 8*a* pivoting in forward motion and opposite direction which is constructed all parts and components according to the present invention.

Figure 3A:
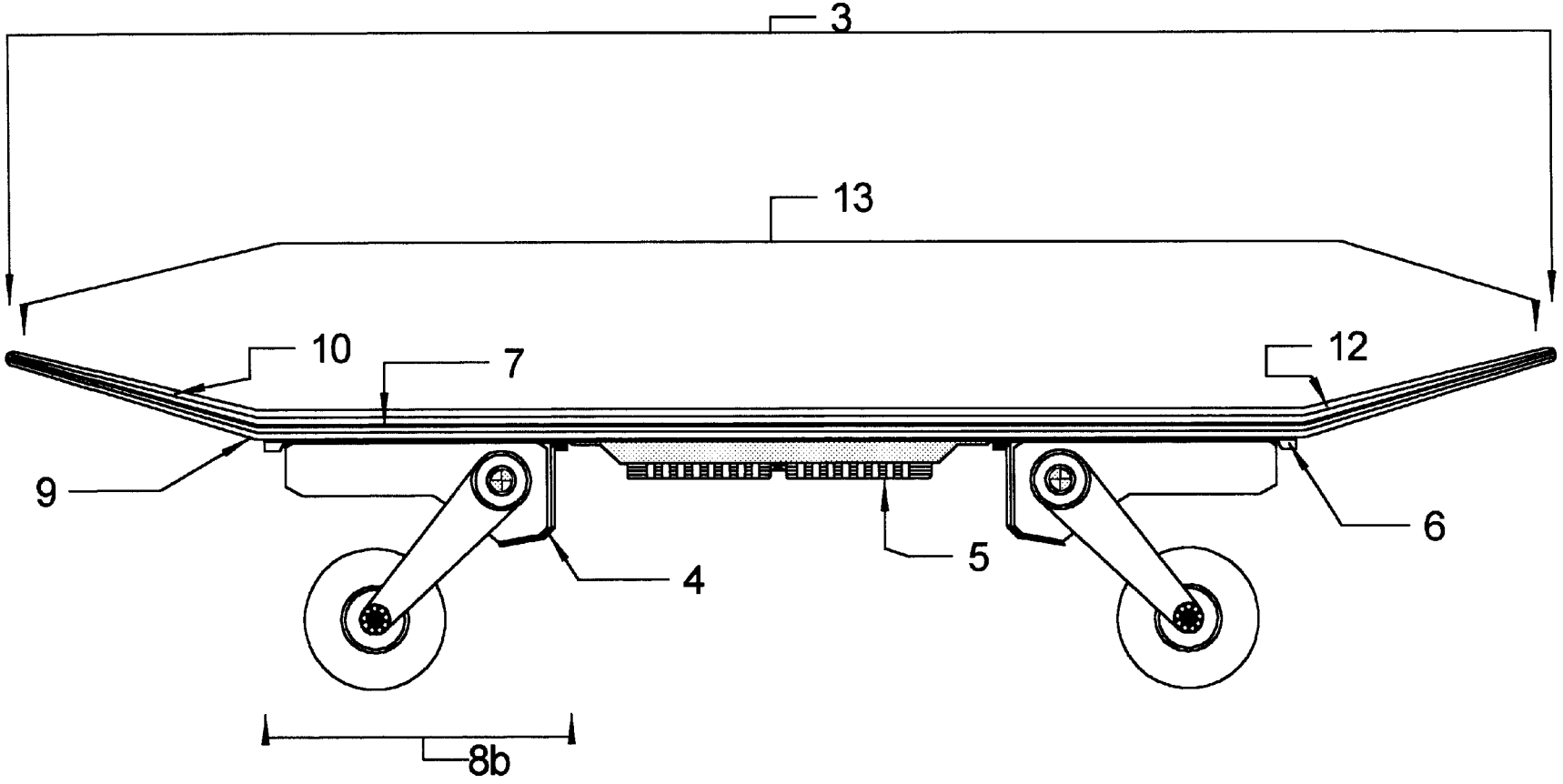
FIG. 3*a* is a side elevation view of a skateboard front and rear independent suspension system eight-wheeled configuration, detailing the innovative design deck side view, rolling devices and suspension protector plate showing all parts and components, which is constructed in according an embodiment of the present invention.

Referring to FIG. 3*a* is a side elevation view of a skateboard front and rear independent integral suspension system 8*b* eight-wheeled configuration and partially side view of the chassis 6 and detailing the innovative deck side view 3, the central middle section of the platform support the in-line-rolling system devices 5, the center of the deck core assembly incorporate the inter-layer middle stainless plate 7 and detailing the core deck base plate 9, the all around bumpers high impacts protector 10 and the side night ride phosphorescent light devices 12, the suspension system rear side incorporate a high impact metal base protector 4, the both end of the platform skateboard deck are bent upward aprox. 18°, the four wheeled suspension system 8*b* pivoting in forward motion and opposite direction which is constructed all parts and components according to the present invention.

Figure 4:
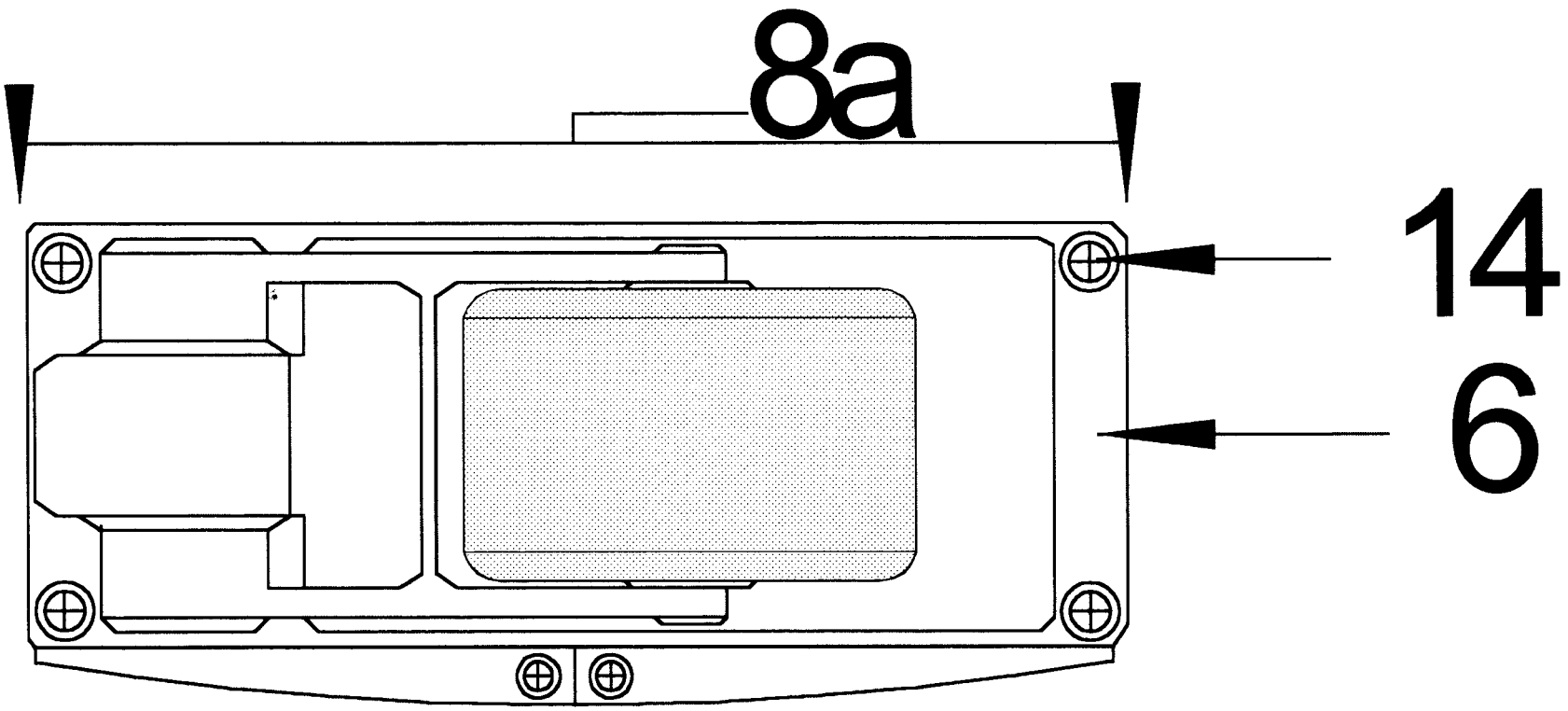
FIG. 4 is a bottom elevation view of a skateboard chassis four-wheeled configuration assembly detailing the suspension system and deck/chassis fasteners supports all parts and components, which is constructed in according an embodiment of the present invention.
Figure 4A:
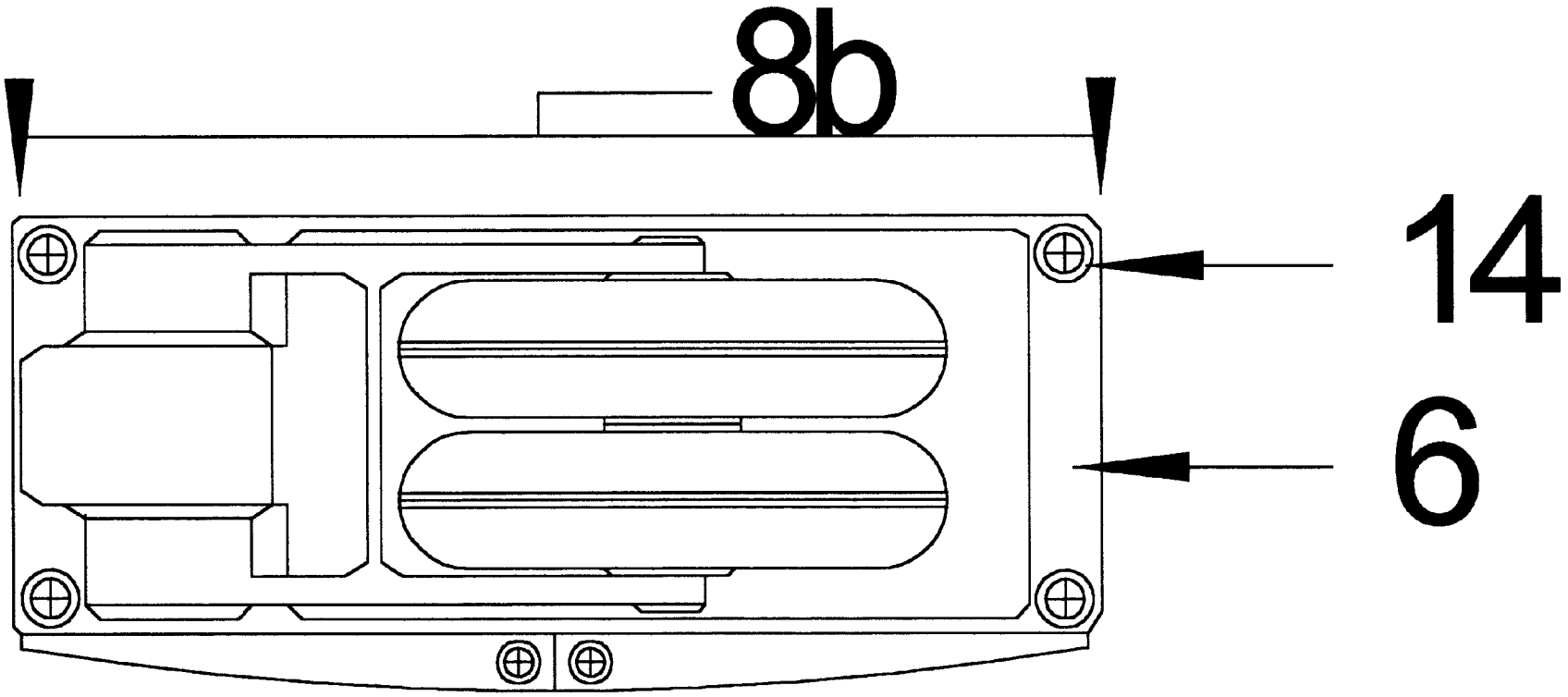
FIG. 4*a* is a bottom elevation view of a skateboard chassis eight-wheeled configuration assembly detailing the suspension system and deck/chassis fasteners supports all parts and components, which is constructed in according an embodiment of the present invention.

Referring to FIG. 4, is a bottom elevation view of a skateboard chassis system 6, detailing a plurality of fasteners 14 and 8*a* suspension assembly four-wheeled configuration arrangement all parts and components constructed in accordance of the present invention. Referring to FIG. 4*a* is a bottom elevation view of a skateboard chassis system 6, detailing a plurality of fasteners 14 and 8*b* suspension assembly eight-wheeled configuration arrangement all parts and components constructed in accordance of the present invention.

Figure 5:
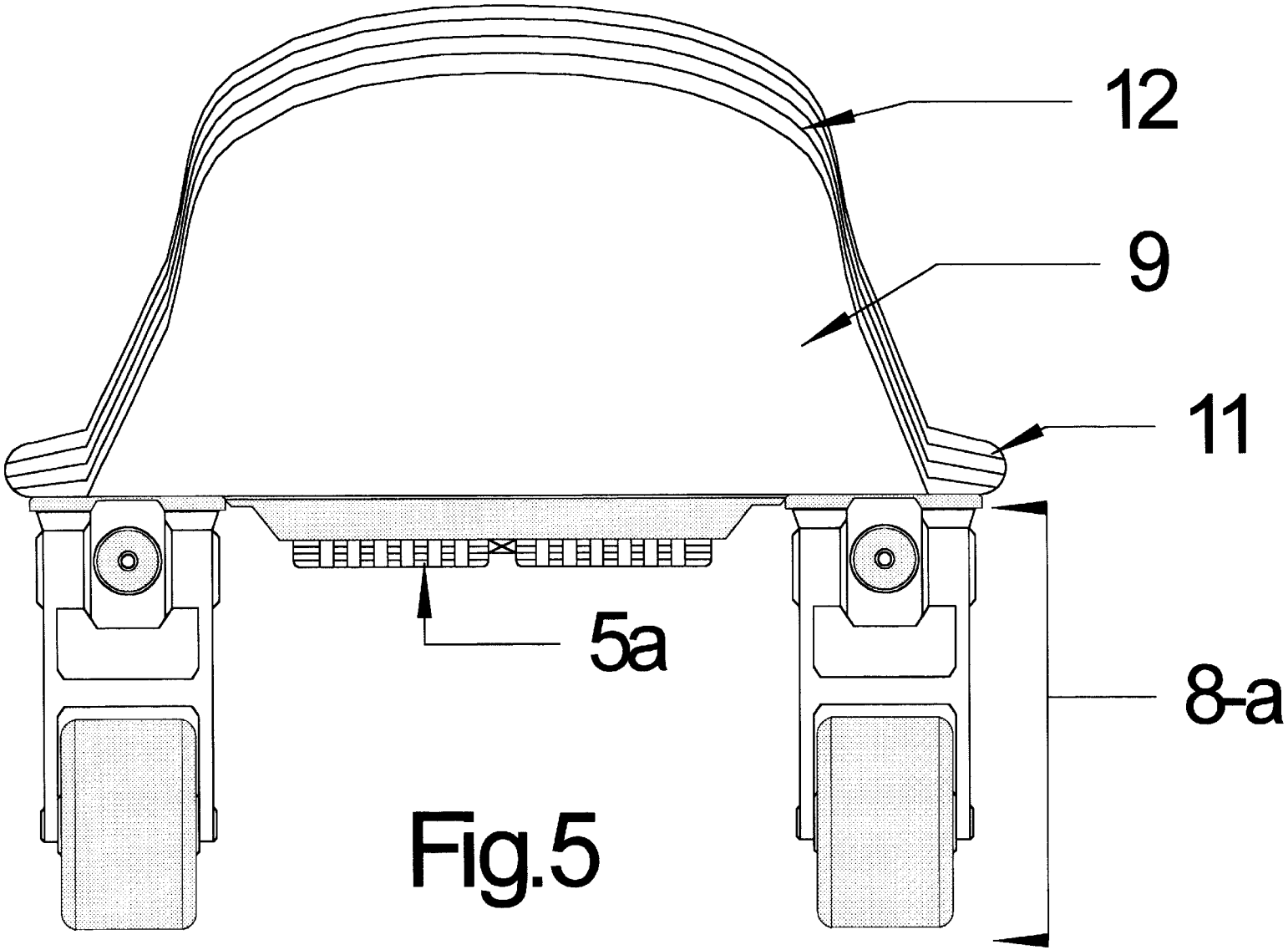
FIG. 5 is a front/rear elevation view of a skateboard four-wheeled configuration detailing the front/rear innovative deck platform aerodynamic design showing front/rear independent suspension and front/rear central rolling devices all parts and components, which is constructed in accordance an embodiment of the present invention.

Referring to FIG. 5, is a front/rear elevation view of a skateboard four-wheeled configuration detailing the suspension system 8*a* and center in-line rolling device 5*a* detailing the front/rear innovative aerodynamic deck view and base plate 9 middle interlayer plate 11 and side edges night ride light devices 12 all parts and components which is constructed in accordance with the present invention.

Figure 5A:
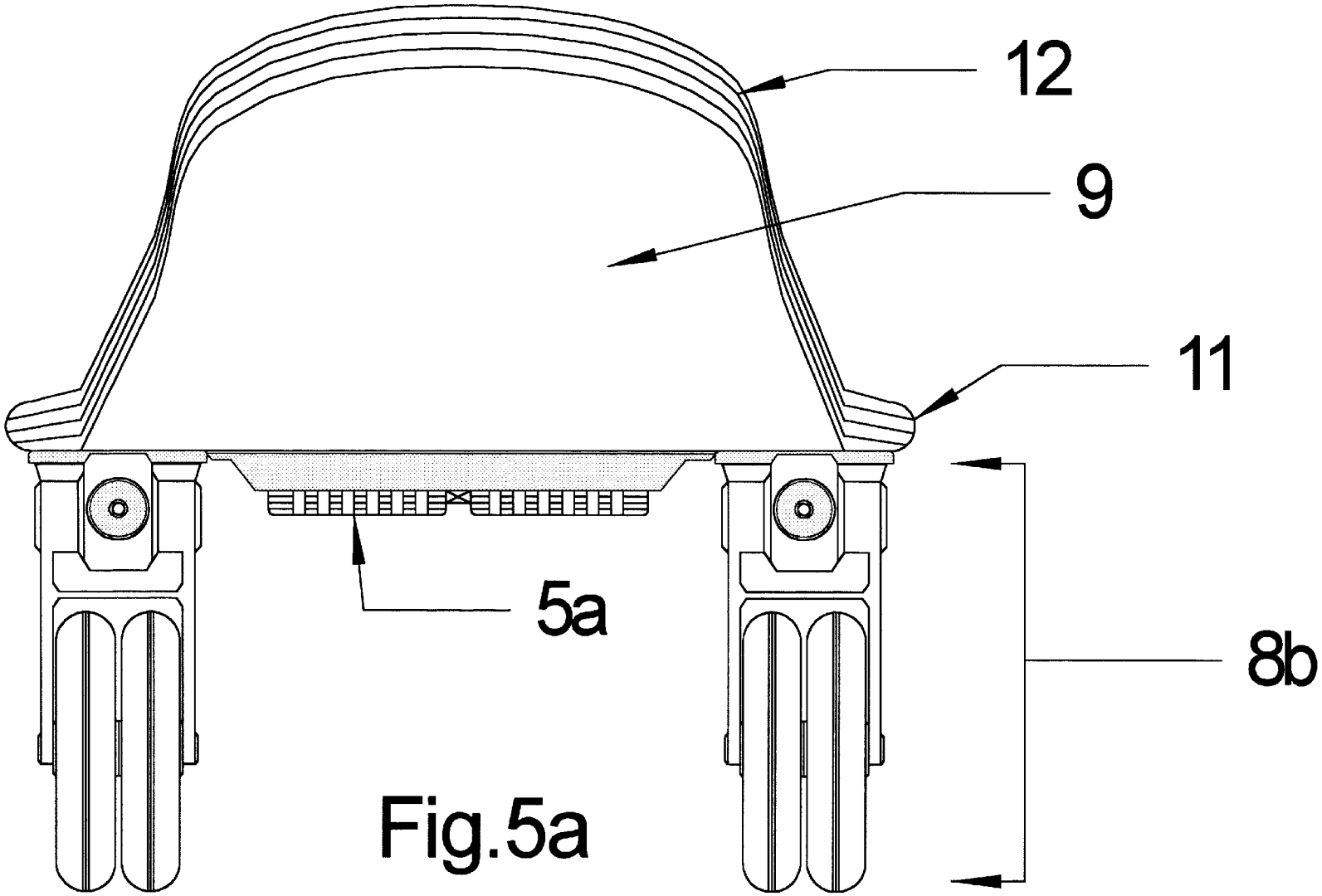
FIG. 5*a* is a front/rear elevation view of a skateboard eight-wheeled configuration detailing the front/rear innovative deck platform aerodynamic design showing front/rear independent suspension and front/rear central rolling devices all parts and components, which is constructed in accordance an embodiment of the present invention.

Referring to FIG. 5*a* is a front/rear elevation view of a skateboard eight-wheeled configuration detailing the suspension system 8*b* and center in-line rolling device 5*a* detailing the front/rear innovative aerodynamics deck view and base plate 9 middle interlayer plate 11 and side edges night ride light devices 12 all parts and components which is constructed in accordance with the present invention.

Figure 6:
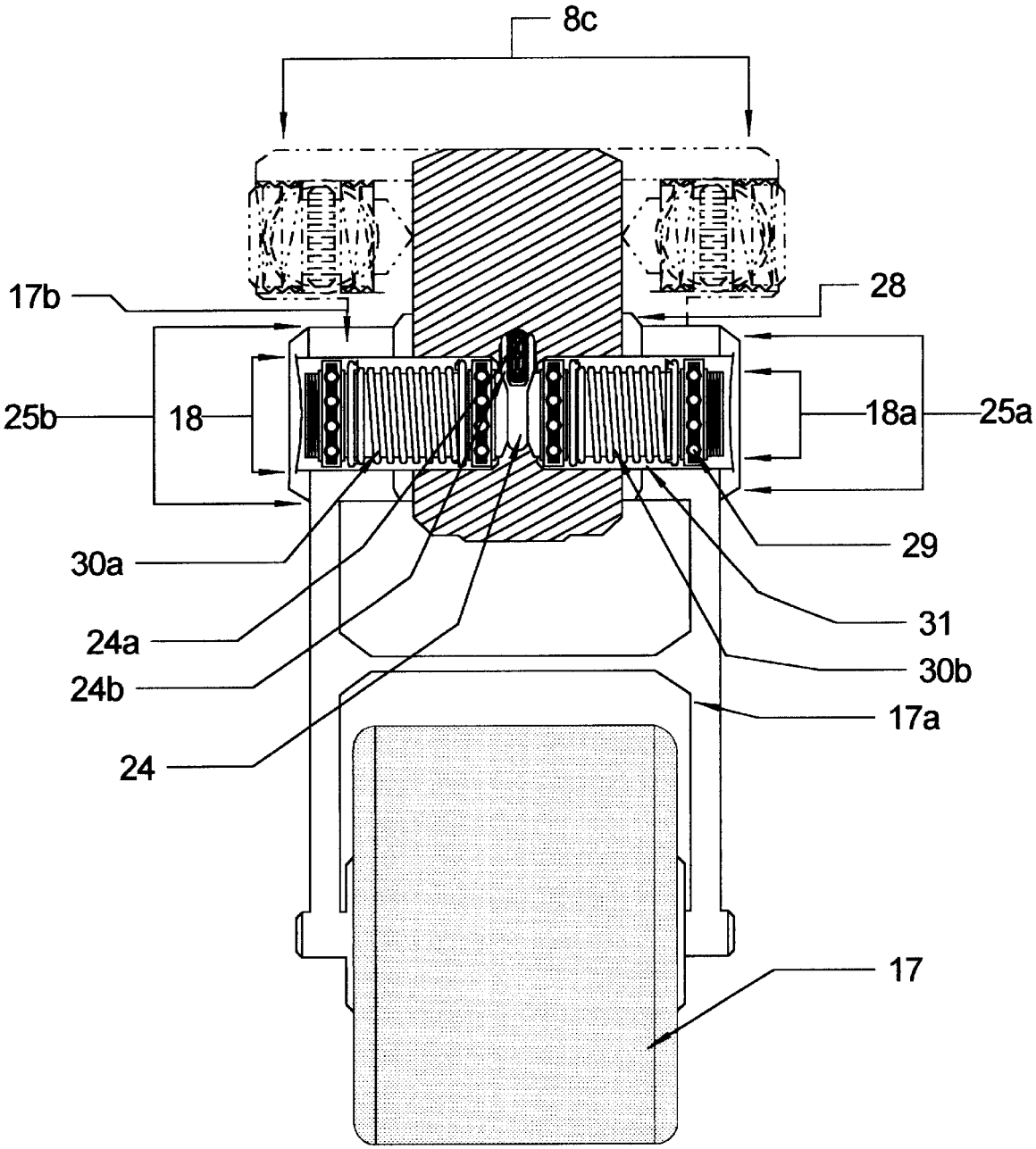
FIG. 6 is a rear elevation in cross sectional view of the skateboard four-eight-wheeled configuration backside sectional independent suspension system, detailing rear axle chamber coils springs and rolling system parts and components, which is constructed in accordance with the present invention.
Figure 7:
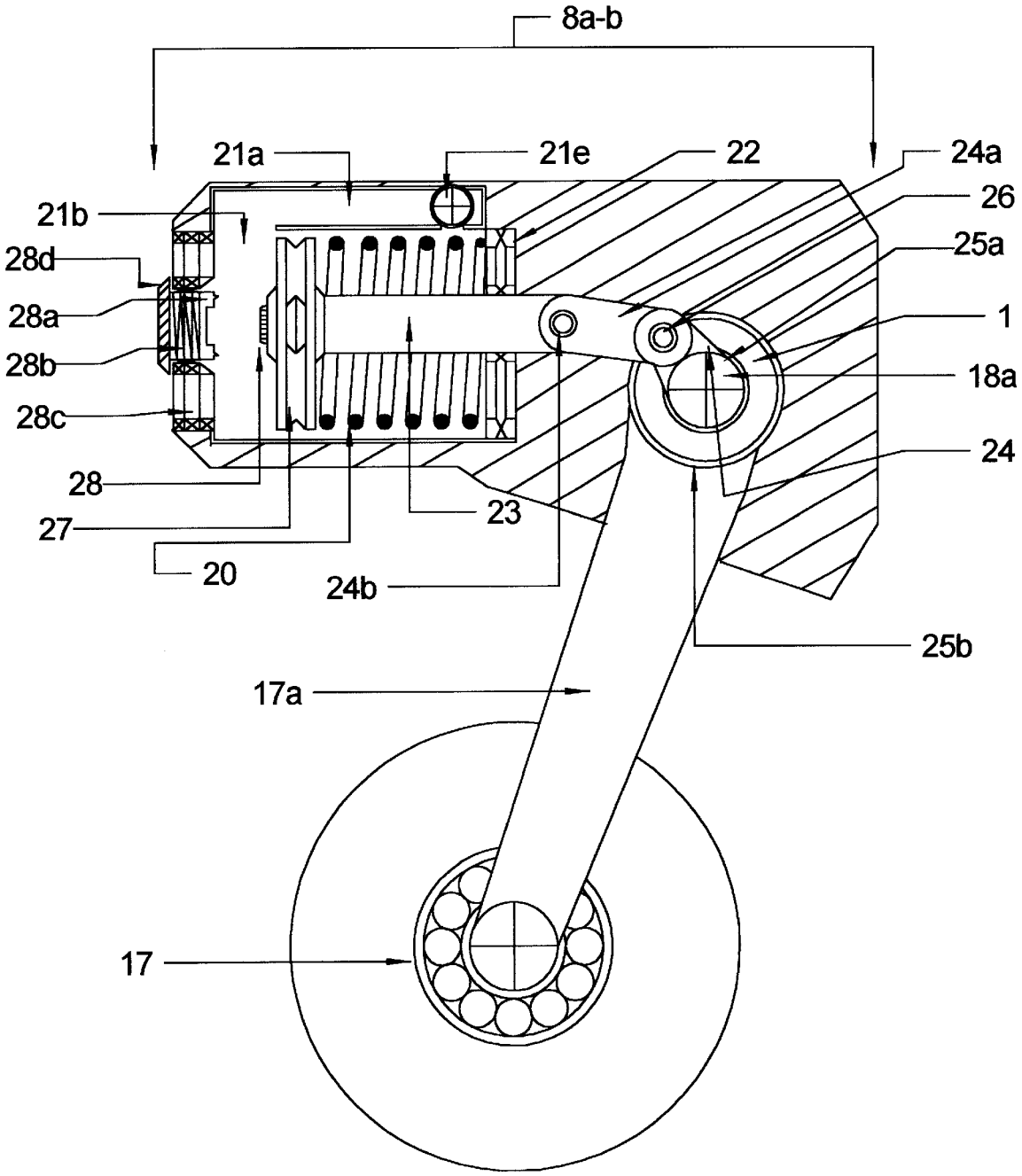
FIG. 7 is a side elevation in cross-sectional view of the skateboard general four-eight-wheeled configuration independent suspension system detailing shock absorber assembly shock-piston and shaft chamber with front adjustable spring, piston bolt and hydraulic fluid by-pass damping screw adjuster all parts and components, which is constructed in accordance with the present invention.

Referring to FIG. 6, is a rear elevation in cross sectional view of the backside assembling of the skateboard independent integral suspension system 8*a*–8*b* detailing rear axle suspension system chamber 18 torsion coils springs 30*b* and ball bearings rolling system 29 and all parts and components constructed in accordance with the present invention. The particularity of this FIG. 6 rear suspension system 8*a*–8*b* is to support down force pressure to the pivoting axle 18*a* keeping the forks 17*a* wheels and rolling system 17 in ground lively position, the rear axle torsion springs coils 30*b* is supported trough a main rear shaft 30*a* and a spring retaining collar 31, the other particularity of this said rear suspension system 8*a*–8*b* it's adjusting the torsion spring coil pressure trough is adjuster knob 25*a* to support and share the total lift weight up-force capacity with the main shock absorber, the middle part of the said rear axle shaft 30*a* support the central head trigger 24 and rolling over a precision rear axle pivot 26 (show in FIG. 7) the forks eyelets 28 and the forks pressure screw covers 25*b* and the forks axle main rolling device 17*b*. Referring to FIG. 7 is a side elevation in cross-sectional view of the independent integral suspension system 8*a*–8*b* detailing the shock absorber chamber assembly section 21*b* and all parts and components of this present invention, the assembly section 21*b* contain the hydraulic fluid reservoir, this said hydraulic fluid chamber 21*b* support the main shaft 23 around the main shaft 23 a shock coil spring 20 take place, and the end part of the said main shaft 23 is attached the shock piston 27, the shock piston 27 front side is attached a adjuster knob 28, this said adjuster knob 28 adjust the compression of the shock coil spring 20, the shock absorber chamber 21*b* rear assembly is supported trough is shaft guide 22 also control and seal the main shaft 23, the main shaft 23 is interconnected with the middle shaft extension 24*a* front part trough a middle pivoting axle 24*b* and the rear part of this said middle shaft 24*a* is attached and connected to the rear pivot head central trigger 24 trough a rear middle pivoting axle 26.

The front section 8*a*–8*b* support the pivoting axle 18*a* this said pivot axle 18*a* support a adjuster knob 25*a* and adjust the coils springs pressure inside the pivoting axle chamber 18*a* and adjuster knob 25*a* pressure screw 25*b*, this said pivoting axle 18*a* is supported with is diagonal aligned forks 17*a* and is rolling system 17.

The front section 8*a*–8*b* detailing a dual hydraulic fluid second reservoir chamber 21 *a*, this said dual extension side chambers 21*a* supporting the hydraulic fluid flow damper control valve 21*e*, this said front section 88*a*–8*b* details the front piston top brake control pad 28*c* and detailing the rubber brake pad 28*a* attached to the removable screw 28*b* and screw cover device 28*d*.

Figure 8:
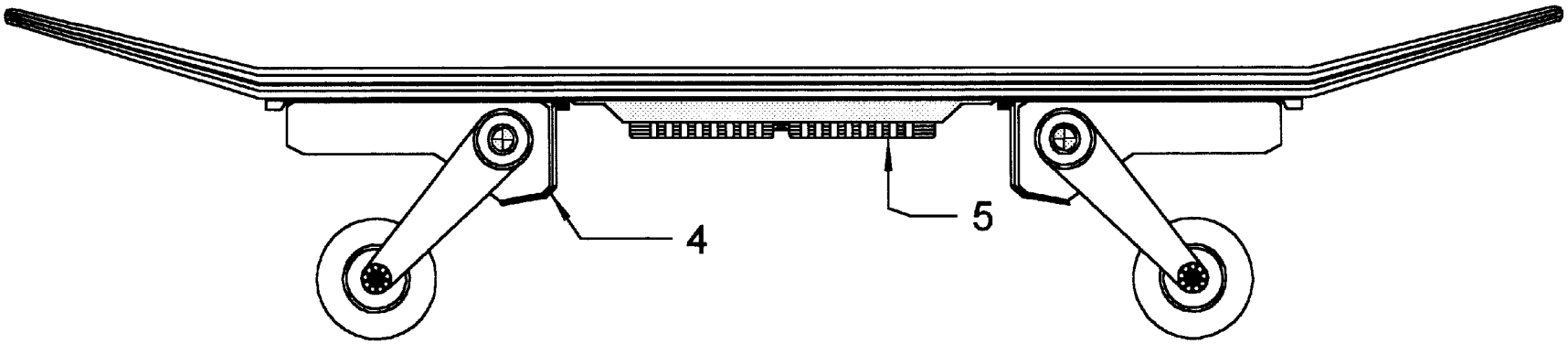
FIG. 8 illustrate a lateral and front/rear elevation view of the skateboard four-wheeled configuration platform deck rolling mounting devices and suspension front and bottom base-plate protector all parts and components, which is constructed in accordance with the present invention.
Figure 8:
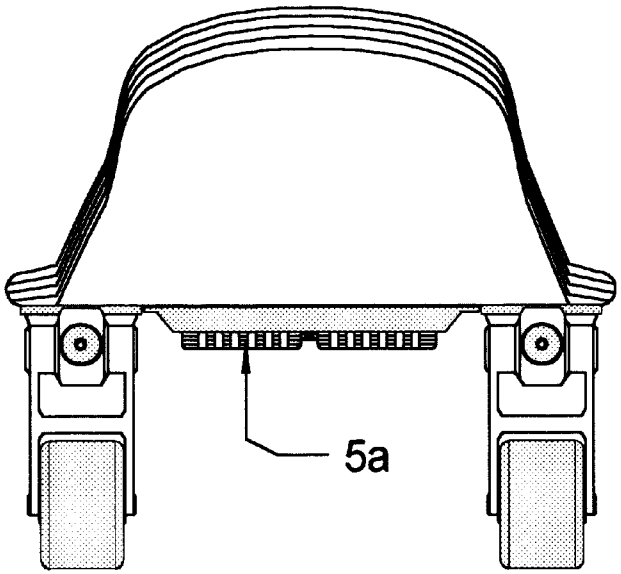
Figure 8A:
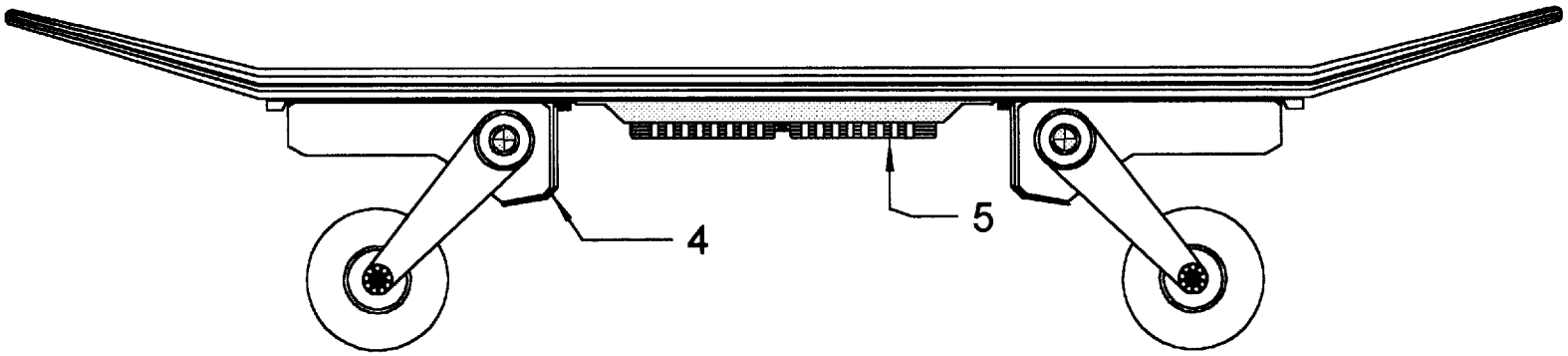
FIG. 8*a* illustrate a lateral and front/rear elevation view of the skateboard eight-wheeled configuration platform deck rolling mounting devices and suspension front and bottom base-plate protector all parts and components, which is constructed in accordance with the present invention.
Figure 8A:
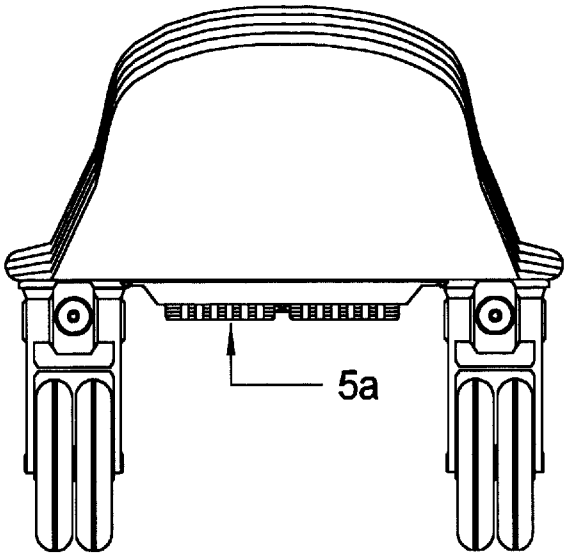

Referring to FIG. 8, this particular section illustrate a side elevation schematic diagrams view of the front dual (double) independent suspension system 8*a*, detailing the front sectional suspension 8*c* and rear sectional suspension 8*d*, maximum and minimum dynamic motions, open and close performance's of suspension power range.

Section 8*c*, represent and support the front suspension system from 8*a* section viewpoint, who represents and support the front axle 18*a*, front fork 17*a* and front rolling system 17, In addition, section 8*d*, who represents the front 8*a* opposite rear axle 18*b*, opposite rear fork 17*b* and opposite rear rolling system 17.

The particular FIG. 8, detailing the front axle 18*a* and rear axle 18*b* general performances of suspension system range, one of the most relevant innovation on this said in-line-roller-skate is the absence of truck or frame device who support partially or totally the wheels axles in the traditional in line roller skate with or with out shock absorber systems.

The front axle suspension system 18*a* and 18*b* opposite suspension system pivoting range will be 0°/47° degrees approx. Between closed wheel 17 (down position/extension) and open wheel 17 (up position/compression) all depends how large or small will be the wheels diameters choice by skaters, the front suspension system 18*a* pivoting range will be up to 130°/140° degree approx. In minimum open position the axle 18*a* and 18*b*, in minimum position the front suspension system 8*a* pivoting range will be approx. 0°/40° degree in close position over the axle 18*a* and 18*b*, the front and rear/opposite 8*b* suspension system has an unlimited opening and closing ranges between 0° and 140° degrees, the rear suspension system 8*b* front section 8*e* FIG. 3 and 8*f* opposite side acts in similar motion conditions like front suspension systems 8*a* FIG. 3. Section 8*c* –8*d*.

Referring to FIG. 8 illustrate a side elevation and backside view of the skateboard four-wheeled configuration platform deck rolling mounting devices 5*a* a lateral platform deck rolling mounting devices 5 and protector suspension plate 4 all parts and components constructed in accordance with the present invention.

Figure 9:
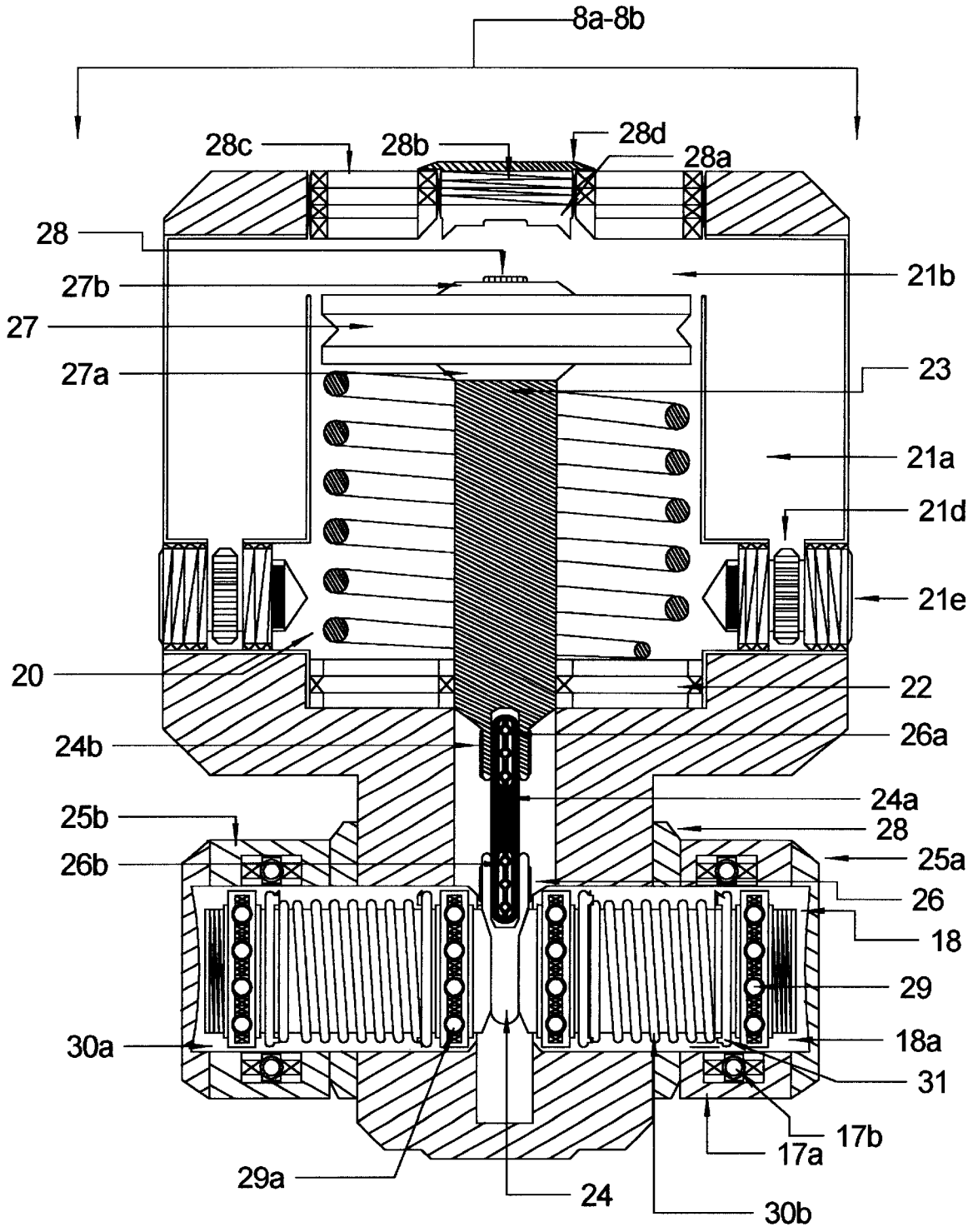
FIG. 9 illustrate a top cross sectional view of the skateboard integral independent suspension multiple system four-eight wheeled configuration parts and components constructed in accordance with the present invention.

Referring to FIG. 9 illustrate the full top cross-sectional view of this said Skateboard independent integral suspension systems, detailing all parts and components constructed in accordance with the present invention.

In this particular skateboard FIG. 9, these drawings represent one of this four integral independent suspension systems from FIGS. 2–2*a* section 8*a*–8*b*, the independent integral suspension system 8*a*–8*b* detailing the shock absorber chamber assembly section 21*b* contain the hydraulic fluid primary reservoir chamber, this said hydraulic fluid chamber 21*b* support the main shaft 23 around the main shaft 23 a shock coil spring 20 take place, the end part of the said main shaft 23 is attached the shock piston 27, the said shock piston 27 front side is attached a adjuster knob 28 and this said adjuster knob 28 adjust the compression and extension pressure of the shock coil springs 20 trough front 27*b* and rear 27*a* adjusting threaded collars, the said shock absorber chamber 21*b* rear assembly is supported trough is shaft guide 22 also this particular shaft guide 22 control and seal the main shaft 23, this said middle shaft 24*a* front part it's interconnected trough a middle pivoting axle 24*b* and the rear part of this said middle shaft 24*a* is attached and connected to the rear pivot head central trigger 24 trough a rear middle precision pivoting axle 26, this said middle pivoting device 26 interconnects the pivot axle 26 and 24*b* with two precision ball bearings devices 26*a*–26*b*.

The suspension system section 8*a*–8*b*, detailing *a* lateral double hydraulic fluid second reservoir chamber 21*a*, this said chamber 21*a* support the shock absorber (extension and compression pressure function) hydraulic fluid flow damper control valve 21*e*, the most relevant characteristic of this said damper control vale 21*e* it's interact with the main piston head 27 and control the shock absorber damper pressure speed of hydraulic fluidflow, the full-flow valve control 21*e* support the 21*d* hydraulic full-flow by-pass device system.

The suspension system section 8*a*–8*b*, support the backside pivoting axle 18*a*, this said pivot axle 18*a* support a adjuster knob 25*a* and rolling 17*b* precision ball bearing and also control and adjust the coils spring pressure inside the pivoting axle chamber 18*a* and adjuster knob 25*a* pressure screw 25*b*, this said pivoting axle 18*a* is supported with is diagonal aligned forks 17*a* and it's rolling system 17.

The backside assembling of the suspension system 8*a*–8*b*, detailing the rear axle 18*a* independent suspension system chamber 18 coils springs 30*b* and ball bearing system 29, the particularity of this said backside suspension coils spring system 30*b* it's to support down force pressure direct to the pivoting axle 18*a* and keeping the said forks 17*a* wheels and rolling system 17 in ground lively contact or position, the rear axle springs coils 30*b* is supported trough a main rear shaft 30*a* and a spring retainer collar 31, the other particularity of this said backside suspension coil spring system 30*b* it's manually adjust the skaters weight coils springs pressure trough is adjuster knob 25*a* to support and share the total lift weight (push-off-force) capacity with the main shock absorber, the middle part of the said backside Pivoting axle shaft 30*a* support the central fixed head trigger 24 and rolling over a precision ball bearing device 26*b*.

The said independent integral suspension system section 8 details the front piston top brake control pad 28*c* and detailing the rubber brake pad 28*a* attached into the removable screw 28*b* and said screw cover device 28*d*.

Figure 10:
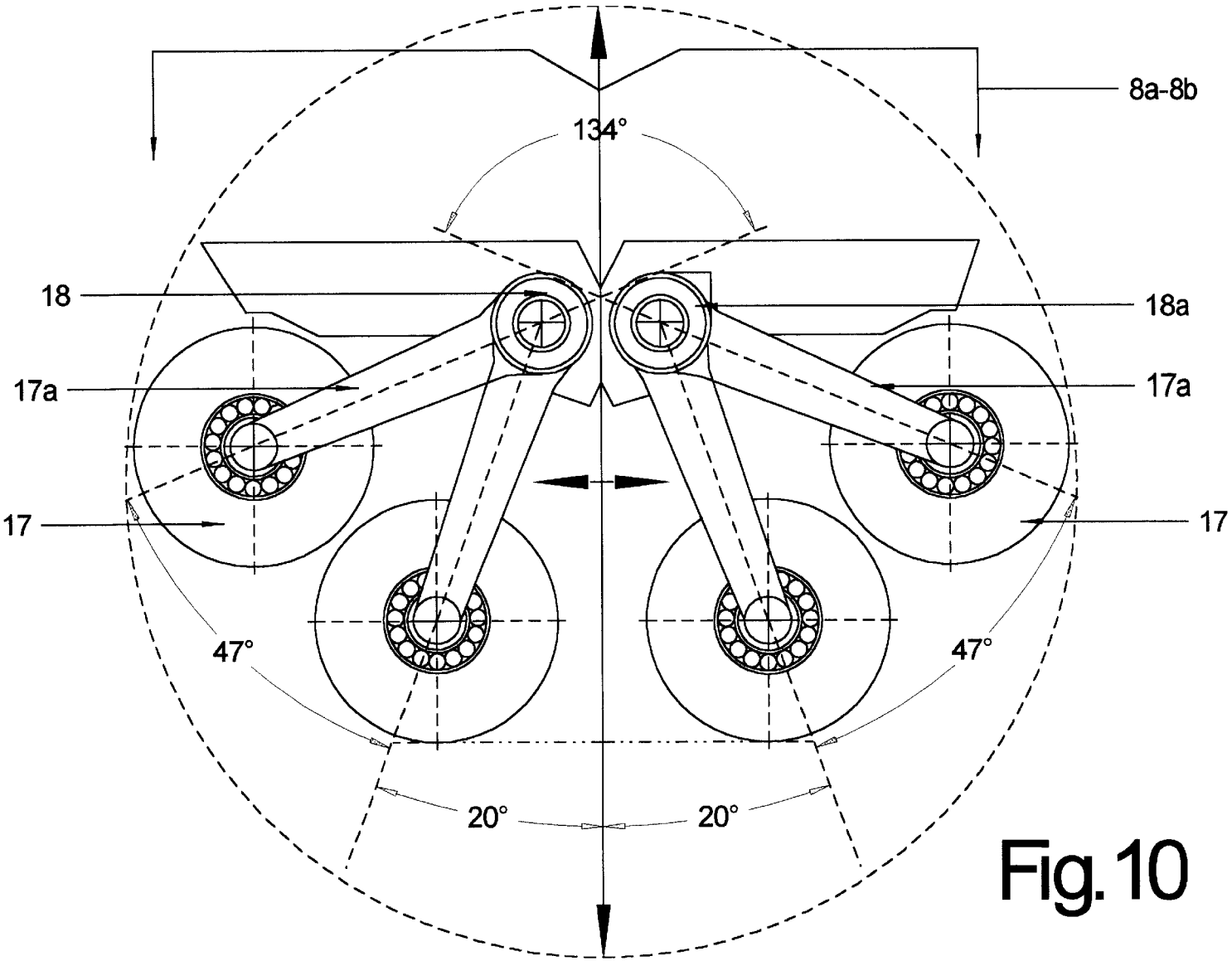
FIG. 10 illustrate a side elevation schematic diagram view of the front/rear four-eight-wheeled configuration independent suspension system, detailing maximum and minimum suspension performance, tolerance ranges and dynamic functions.

Referring to FIG. 10 this particular section illustrate a side elevation schematic diagrams view of the skateboard independent integral suspension system 8*a*–8*b*, detailing the independent integral suspension system 8*a*–8*b* variable geometry wheel travel angular dynamic and performance of suspension power ranges.

This particular FIG. 10, detailing the general performance of the suspension system ranges, one of the most relevant innovation on this said skateboard is the absence of truck devices that support partially or totally the wheels axles system in the traditional or improved skateboards with or without shock absorber systems.

Figure 11:
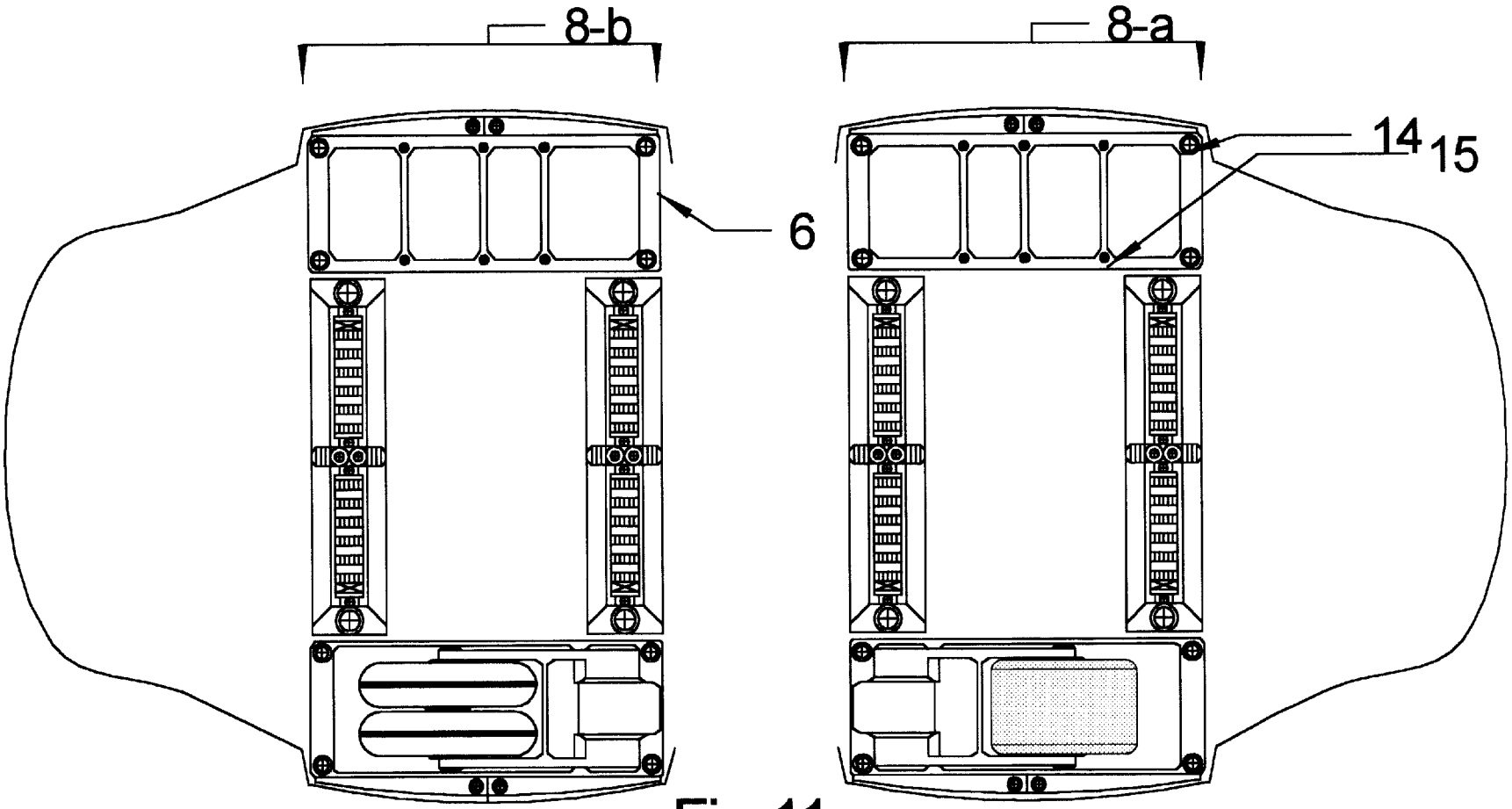
FIG. 11 illustrate a bottom elevation view of the skateboard chassis assembling, detailing the bottom view of the eight-wheeled configuration independent suspension mounting system all parts and components, which is constructed in accordance with the present invention.

Referring to FIG. 11 illustrate a bottom preferred elevation view of the skateboard detailing the all four 8*a*–8*b* suspension system assembly, full view of the chassis assembling 6 which is overview the plurality of fasteners 14 who supporting the chassis 6 against the deck platform, review a plurality of fasteners 15 who supports the body of the suspension system, finally review a plurality of fasteners 16 who supporting against the deck platform the plurality of in-line rolling devices.

Objects and Advantages

Principal objects, advantages and novel features of the present invention are:

(a) to provide a skateboard with independent integral suspension truck-free system not available in any conventional or improvement skateboards.

(b) to provide a skateboard with aerodynamic new deck assembly design than other existing skateboards.

(c) to provide a skateboard with supreme dynamic push-off-force with highest performance and extreme stability not available in any other conventional or improved skateboard.

(d) to provide a skateboard with longitudinal and lateral mounted rolling device which allows skating with precision frontal and lateral sliding maneuvers without damaging the bottom of the deck surface like conventional or improved skateboards.

(e) to provide a skateboard with capability of interchange from conventional fourwheeled arrangement to eight-wheeled arrangement than any other conventional or improved skateboards.

(f) to provide a skateboard to participate in extreme sporting conditions which allow longer and higher acrobatic jumping and free-style technique maneuvers than any other available skateboards.

(g) to provide a skateboard to go faster, smoother-riding than any other available conventional or improved skateboard.

These, and others additional objects, advantages and novel futures of this present invention will become apparent after reading the detailed descriptions and arrangements of the preferred embodiments therefore in reference to the appended drawings and text.

What is claimed is:

1. A skateboard integral interchangeable independent suspension truck-free with aerodynamic board design and rolling devices system, comprising:

(a) a deck platform having four deck fender extensions which are support and interconnect said four removable independent chassis systems, said independent chassis support four independent integral suspension truck-free having four or eight-wheels configuration, said deck platform supports a plurality rolling devices system, said rolling devices system mounted and aligned longitudinally under the middle section of said deck platform, said deck platform also having bumpers mounted along the edge of said skateboard, said bumpers supporting phosphorescent light indicator devices, said deck platform is aerodynamic design means top section comprising a flat-board platform surface with both top section comprising a longitudinal ended platform supporting an angular upward bent from 0–18 degrees, said middle section having a right side and left side rectilinear edge, said deck middle section also comprises a top side extension fender which used at control area for operable steering and general maneuvers;

b) a chassis supporting an interconnecting said integral interchangeable independent suspension truck-free system with a platform bottom section and supporting said four-wheeled or eight-wheeled suspension configuration, said chassis system interconnects with said platform deck through a plurality of fasteners and mounted individually under said deck platform middle-half section of either said fender extension;

c) an integral independent suspension system support said four-wheeled or eight-wheeled suspension configuration, said integral independent system means all parts and components are integrated in a body-frame, said four-wheeled or eight-wheeled suspension configuration having all forks axles pivotally in forward motion and opposite directions from each other, said integral independent suspension system mounted directly under said chassis structure and attached with a plurality of removable fasteners and said integral independent suspension system supported front and rear shock absorber assemblies, said forks and said rolling devices;

d) front and rear shock absorber assemblies having a shock absorber main shaft inside a shock-chamber assembly, said shock absorber main shaft support around a shock coils springs, the shock absorber main-shaft having a rear side pivotally attached a middle-shaft, the shock absorber main-shaft also having a front side engaged to a shock piston, the shock piston having a front part attached to a shock coils spring adjuster knob, said shock chamber assembly contain hydraulic fluid in a main reservoir, said shock absorber main reservoir assembly support said hydraulic flow control by-pass valves, the shock chamber assembly having a front section comprising a rubber brake impact control pad covered by a removable screw, the shock chamber assembly having a rear section attached to a shaft seal guide assembly device, the middle shaft interconnects with said shock absorber main shaft rear side at one end the other end interconnects with a head central trigger device, the middle shaft interconnects to the rear of said main shaft and to the front of said trigger head by pivot axles;

e) a rolling devices system means a plurality of said in-line rolling devices longitudinally aligned under the central position of the deck platform parallel with the inside portion of said suspension system, a rolling devices means a plurality of said in-line rolling devices laterally aligned under the central position of the deck platform between the suspension system and the rectilinear both sides edge.

* * * * *